US011821208B2

(12) United States Patent
Yang et al.

(10) Patent No.: US 11,821,208 B2
(45) Date of Patent: Nov. 21, 2023

(54) ANCHOR ASSEMBLY HAVING PRE-STRESSED MANDREL

(71) Applicant: ZHEJIANG PROVINCE INSTITUTE OF ARCHITECTURAL DESIGN AND RESEARCH, Hangzhou (CN)

(72) Inventors: Xuelin Yang, Hangzhou (CN); Wenwei Zhu, Hangzhou (CN); Migang Shen, Hangzhou (CN)

(73) Assignee: ZHEJIANG PROVINCE INSTITUTE OF ARCHITECTURAL DESIGN AND RESEARCH, Hangzhou (CN)

( * ) Notice: Subject to any disclaimer, the term of this patent is extended or adjusted under 35 U.S.C. 154(b) by 0 days.

(21) Appl. No.: 17/504,493

(22) Filed: Oct. 18, 2021

(65) Prior Publication Data

US 2022/0412089 A1 Dec. 29, 2022

(30) Foreign Application Priority Data

Jun. 3, 2021 (CN) ..... 202110619979.0

(51) Int. Cl.

| | |
|---|---|
| ***E04C 5/12*** | (2006.01) |
| ***E02D 5/58*** | (2006.01) |
| ***E04C 5/06*** | (2006.01) |
| ***E04C 5/16*** | (2006.01) |

(52) U.S. Cl.

CPC ..... *E04C 5/12* (2013.01); *E02D 5/58* (2013.01); *E04C 5/0618* (2013.01); *E04C 5/0631* (2013.01); *E04C 5/162* (2013.01); *E02D 2300/0034* (2013.01)

(58) Field of Classification Search

CPC ..... E04C 5/12; E04C 5/0618; E04C 5/0631; E04C 5/162; E02D 5/58; E02D 2300/0034

USPC ..... 52/223.13

See application file for complete search history.

(56) References Cited

U.S. PATENT DOCUMENTS

| | | | | |
|---|---|---|---|---|
| 1,708,277 A * | 4/1929 | Martin | E04C 5/208 | 52/649.7 |
| 1,759,626 A * | 5/1930 | Ockels | E04C 5/18 | 52/249 |
| 3,257,767 A * | 6/1966 | Lassy | E04C 5/18 | D8/382 |
| 3,449,876 A * | 6/1969 | Howlett | E04C 5/122 | 52/223.13 |

(Continued)

*Primary Examiner* — Brent W Herring

(74) *Attorney, Agent, or Firm* — W&G Law Group

(57) ABSTRACT

Provided is an anchor assembly having a pre-stressed mandrel, which consists of an inner pre-stressed concrete mandrel and an outer cast-in-place anchoring slurry, wherein pre-stressed tendons are arranged inside the concrete mandrel and are prefabricated by a pretensioning method; the anchoring slurry wraps the pre-stressed concrete mandrel, and the cast-in-place anchoring slurry is formed by placing the pre-stressed concrete mandrel in a pile hole, and solidifying after primary grouting or secondary grouting. According to the anchor assembly, the pre-stress is not required to be tensioned and locked on site, so that the quality of the pre-stressed mandrel can be ensured, the on-site construction period can be greatly shortened, and the existing pre-stressed and common non-pre-stressed anchors can be replaced.

8 Claims, 3 Drawing Sheets

(56) References Cited

U.S. PATENT DOCUMENTS

| | | | | | |
|---|---|---|---|---|---|
| 3,795,949 | A * | 3/1974 | Shorter | E04C 5/122 | 52/223.13 |
| 3,909,142 | A * | 9/1975 | Surr | E04C 5/12 | 403/41 |
| 4,055,929 | A * | 11/1977 | Stancati | E04B 1/4121 | 411/965 |
| 4,166,347 | A * | 9/1979 | Pohlman | E04G 21/12 | 52/301 |
| 4,671,034 | A * | 6/1987 | Rehm | E04C 5/12 | 52/223.13 |
| 5,269,113 | A * | 12/1993 | Dreizler | E04C 5/201 | 52/649.1 |
| 2016/0333583 | A1* | 11/2016 | Gan | E04C 5/122 | |
| 2020/0240099 | A1* | 7/2020 | Huo | E02D 7/00 | |

* cited by examiner

ANCHOR ASSEMBLY HAVING PRE-STRESSED MANDREL

CROSS-REFERENCE TO RELATED APPLICATIONS

The present application claims priority to Chinese Patent Application No. 202110619979.0, filed on Jun. 3, 2021, the content of which is incorporated herein by reference in its entirety.

TECHNICAL FIELD

The present application relates to the construction field of anchors, in particular to an anchor assembly having a pre-stressed mandrel.

BACKGROUND

In areas with abundant groundwater, there is a widespread problem of basement anti-floating. An anchor is an effective measure for anti-floating of underground structures in construction engineering, one end of which is connected with engineering structures, and the other end is deep into the stratum, which can transmit a tensile force to the stratum. In addition, anchors are also used to reinforce the main body of tunnels and dams, and to resist wind and capsize of high-rise buildings. The anchor is widely used, and has a very mature standardization system and construction process. Relevant national and industrial standards include Technical Specifications for Rock and Soil Anchor and Shotcrete Support Engineering (GB 50086-2015), Technical Specifications for Rock and Soil Anchor (Cable), and special chapters on anchor are also involved in Technical Specifications for Foundation Pit Support and Technical Standards for Anti-floating of Building Engineering.

In terms of types, anchors are divided into grouting and mechanical pre-stressed anchors, tension and pressure pre-stressed anchors, load dispersed anchors, full-length bonded anchors, resin roll and quick-hardening cement roll anchors, hollow grouting anchors and friction anchors, etc. The common feature of these anchors is that they are cast in situ.

For the convenience of construction, non-pre-stressed anchors are often used as anti-floating anchors in underground engineering, and the conventional construction process is as follows: anchor fabrication→drilling machine in place→emptying→anchor installation→pressure grouting→completion. The above anchors have the remarkable advantages of high bearing capacity, reliable quality, simple process and low comprehensive cost.

Because of its small diameter and relatively large tensile bearing capacity, a non-pre-stressed anchor is prone to durability problems due to cracks. Especially in the site where soil and water are corrosive to rebars, cracks in anchors cause rebars to rust expansion, resulting in overall anti-floating failure. According to the requirements of "Technical Standard for Anti-floating of Building Engineering" (JGJ476-2019), the anti-floating design grade A project should be designed according to the fact that the anchor anchorage slurry does not produce tensile stress; the project with an anti-floating design grade of B should be designed without cracks, and pre-stressed anchors must be adopted.

Pre-stressed technology can effectively control cracks and improve the durability of anchors, but pre-stressed anchors can only be tensioned after the bottom slab of the basement is poured, as shown in FIG. 1. The construction period is long when the bottom slab is tensioned, and the preformed holes in the bottom slab can easily cause the basement to leak water.

SUMMARY

Different from the characteristic that all concrete anchors are poured on site at present, the present application provides an anchor assembly having a pre-stressed mandrel, which comprises a prefabricated pre-stressed concrete mandrel and a cast-in-place anchoring slurry, wherein a grouting pipe is preformed in advance at the mandrel part, or a grouting pipe is bound outside the finished mandrel for secondary grouting, so as to improve the bonding performance between the anchor and the hole wall, thereby improving the pullout resistance of the anchor. The anchor can solve the problem that a pore canal must be preformed in the bottom slab in the existing pre-stressed anchor, thus causing water leakage in the basement.

The purpose of the present application is achieved by the following technical solution.

An anchor assembly having a pre-stressed mandrel includes:

a pre-stressed concrete mandrel positioned at an inner side, wherein pre-stressed tendons are arranged inside the pre-stressed concrete mandrel and are prefabricated by a pretensioning method; and a cast-in-place anchoring slurry is positioned at an outer side, wraps the pre-stressed concrete mandrel, and is formed by placing the pre-stressed concrete mandrel in a pile hole and solidifying the anchoring slurry after primary grouting or secondary grouting.

Furthermore, an outer circumferential surface of the pre-stressed concrete mandrel is provided with a mandrel positioning device and a grouting pipe preformed groove.

Furthermore, there are three pre-stressed tendons in the pre-stressed concrete mandrel.

Furthermore, a radius R1 of the pre-stressed concrete mandrel is 50-75 mm, and a thickness of the anchoring slurry is 30-60 mm.

Furthermore, the anchoring slurry is a cement slurry.

Furthermore, in order to enhance the bonding performance between the pre-stressed concrete mandrel and the cast-in-place anchoring slurry, the outer peripheral surface of the pre-stressed concrete mandrel is provided with bamboo-like or point-like protrusions or recesses.

Furthermore, the pre-stressed concrete mandrel can be in the shape of a frustum with a small top and a large bottom.

A construction method of an anchor assembly having a pre-stressed mandrel includes the following steps:

S1, prefabricating a pre-stressed concrete mandrel by a pretensioning method in a factory, wherein a diameter of the prefabricated mandrel is controlled between 100 mm and 150 mm; tensioning a rebar on a pedestal first, then pouring a concrete mandrel, and preforming a grouting pipeline in the mandrel; after a strength reaches a design value, releasing a tension end to make the mandrel form prestress; at the same time, reserving a section of the rebar at one side of the mandrel for anchoring, and cutting off the rebar at the other side along an end of the mandrel;

S2, drilling holes by a drilling machine on a construction site;

S3, hole cleaning, binding the grouting pipe, and then lowering the prefabricated mandrel to ensure that the pre-stressed concrete mandrel and the drilling hole are coaxial;

S4, performing primary grouting around the pre-stressed concrete mandrel, and performing secondary grouting as a cast-in-place anchoring slurry after solidification and shrinkage followed by the primary grouting;

S5, anchoring the rebar reserved in the mandrel into a bottom slab, and pouring the bottom slab so as to complete basement construction.

Furthermore, an expansion agent is added to the concrete when pouring the concrete mandrel in S1.

The present application has the following beneficial effects:

(1) In corrosive sites, cracks usually occur in ordinary anchors, which reduces their durability; under the long-term action of fluctuating groundwater levels and alternating wet and dry environment, the subtle cracks will also expand continuously, which will make the rebars in the members rusted and reduce their strength, thus leading to serious potential safety hazards. In this regard, the mandatory requirement of using pre-stressed anchors for projects with a design grade A and grade I have been put forward in the new industry specification; for anchors with a design grade C, more than 60-70% of rebars can be saved. According to the anchor assembly, the pretensioning prestress process is adopted, and the anchor body is pre-stressed, so that the mandrel of the anchor assembly can meet the requirement of no cracks in the specification, and the durability and economy of the anti-floating anchor can be effectively improved.

(2) At present, the conventional pre-stressed anchor can be tensioned only after the basement bottom slab is poured, and the construction technology is cumbersome, which has a great influence on the construction period. Different from the characteristics that all concrete anchors are poured on site at present, the prefabricated mandrel is produced in the factory, lowered and installed in the construction site, and the anchoring slurry is poured to form the anchor assembly. The current assembly concept and practice of a superstructure are successfully applied to the field of anti-floating anchors, resulting in prefabricated components and assembly practices in the anti-floating field of foundation engineering. Compared with non-pre-stressed anchors and conventional retard-bonded pre-stressed anchors, this innovative method can not only ensure the quality of pre-stressed mandrel, but also greatly shorten the construction period and reduce the overall cost.

Figure 1:
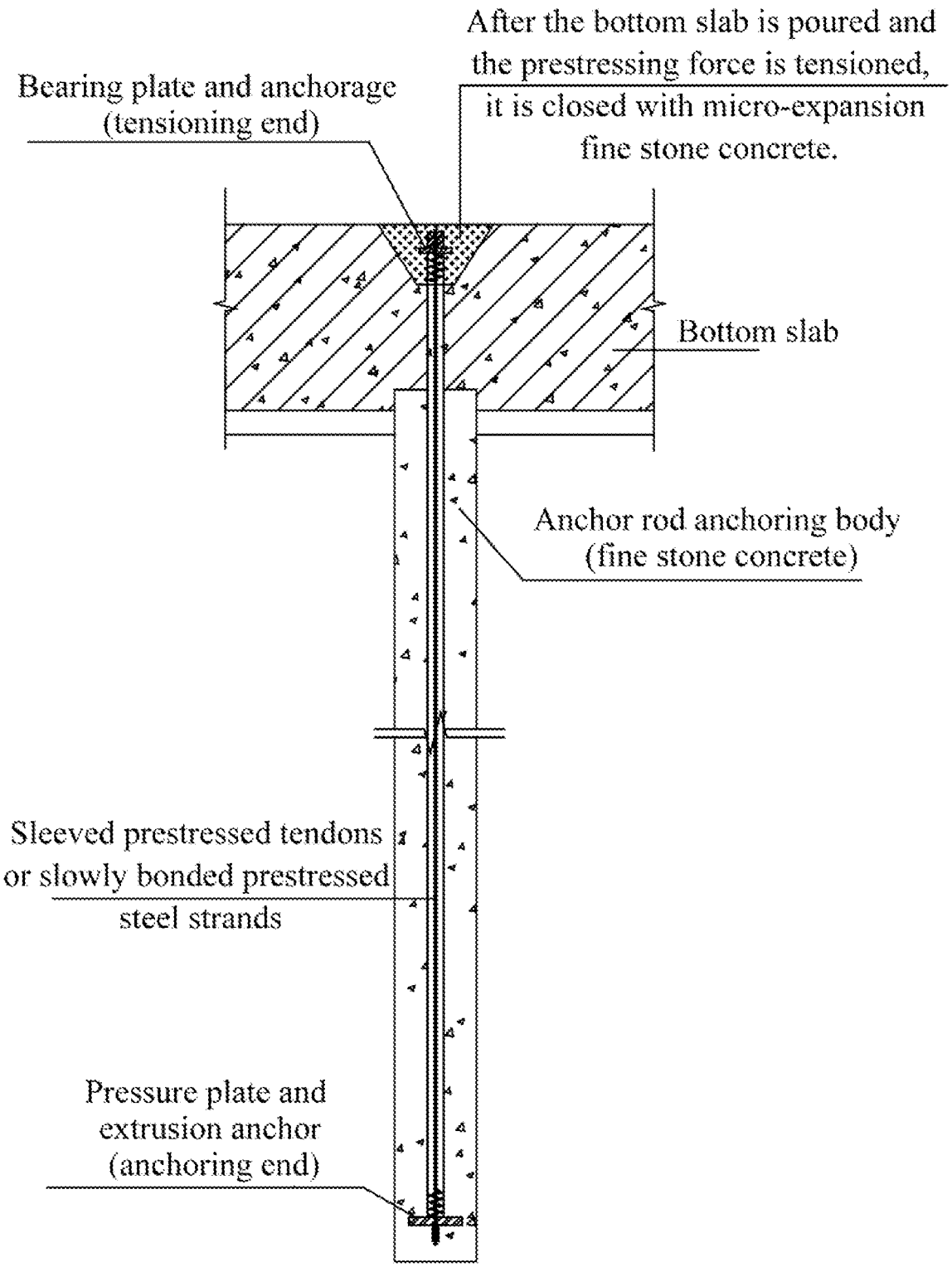
FIG. 1 (prior art)
FIG. 1 is a construction drawing of a pre-stressed anchor in the prior art.

Reference Signs: pre-stressed concrete mandrel 1, cast-in-place anchoring slurry 2, bottom slab 3, grouting pipe 4, mandrel positioning device 5, pre-stressed tendon 101, mandrel concrete 102, grouting pipe preformed groove 103, and point-like protrusions 104.

DESCRIPTION OF EMBODIMENTS

The purpose and effect of the present application will become more clear by describing the present application in detail according to the drawings and preferred embodiments. It shall be understood that the specific embodiments described here are only intended to explain the present application, and are not used to limit the present application.

The anchor assembly having a pre-stressed mandrel has three innovations:

(1) The traditional pre-stressed anti-floating anchors are all poured on site, and the anchor assembly of the present application is a combination of factory prefabrication and on-site pouring;

(2) There are only two methods for non-pre-stressed anchor and full pre-stressed anchor. The prefabricated mandrel of the anchor assembly of the present application is a pre-stressed member, while the anchoring slurry poured on site is a non-pre-stressed member;

(3) The traditional pre-stressed anti-floating anchor must be tensioned on the basement bottom slab, and it cannot form a complete stress system itself. A prestress is only established in the mandrel body below the bottom slab for this novel anchor, forming a self-balancing system without the bottom slab, and thus achieving better safety under the subsequent basement construction conditions.

Figure 2:
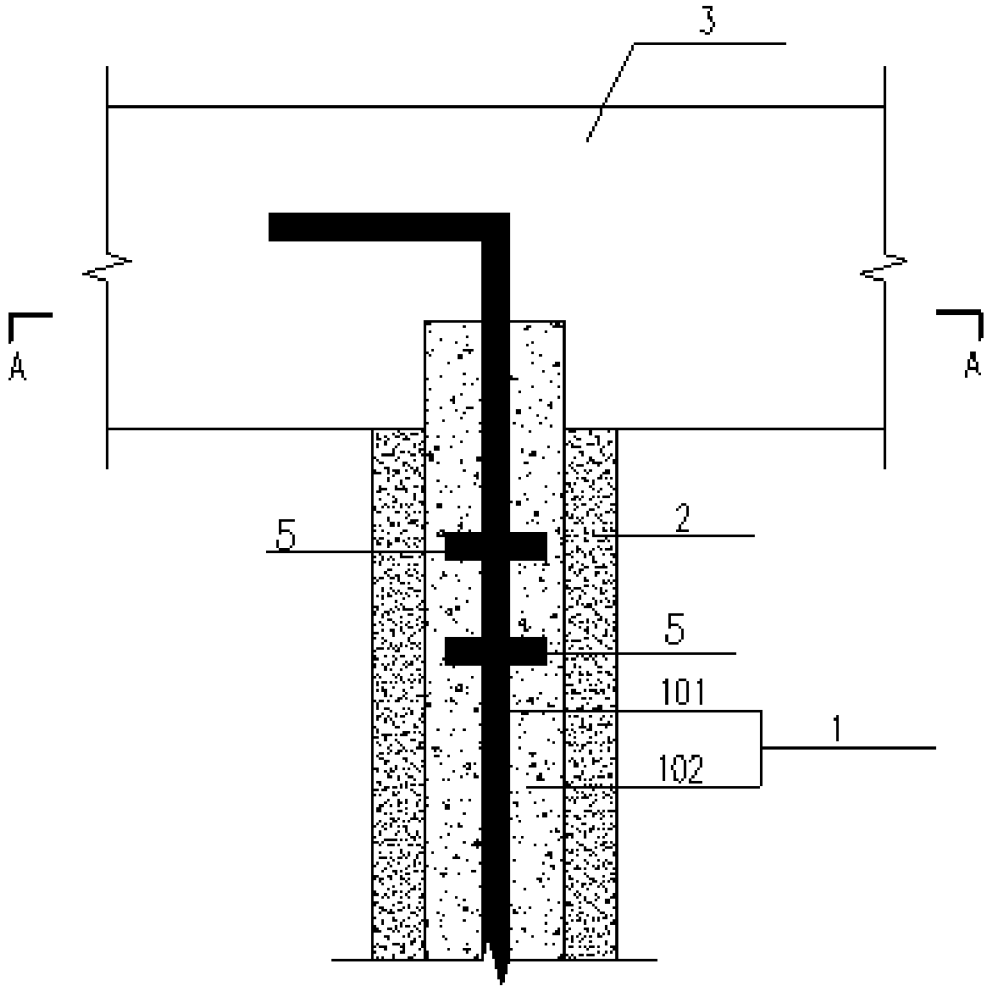
FIG. 2 is a schematic diagram of the anchor assembly of the present application.

As shown in FIG. 2, the anchor assembly having a pre-stressed mandrel of the present application incudes:

a pre-stressed concrete mandrel 1 positioned at the inner side, wherein the pre-stressed concrete mandrel 1 is prefabricated by a pretensioning method and internally provided with a pre-stressed tendon 101;

a cast-in-place anchoring slurry 2 located at an outer side, which wraps a pre-stressed concrete mandrel 1, and is formed by placing the pre-stressed concrete mandrel 1 in a pile hole and then performing primary grouting and solidification; when the anchoring slurry is a cement slurry, the anchoring slurry will be formed after primary grouting and solidification, but when the anchoring slurry is mixed mortar, the slurry will shrink greatly after primary grouting and solidification, thus causing cracks in the anchoring slurry. At this time, secondary grouting is needed, and the whole anchoring slurry will be obtained after secondary grouting and solidification.

Figure 3:
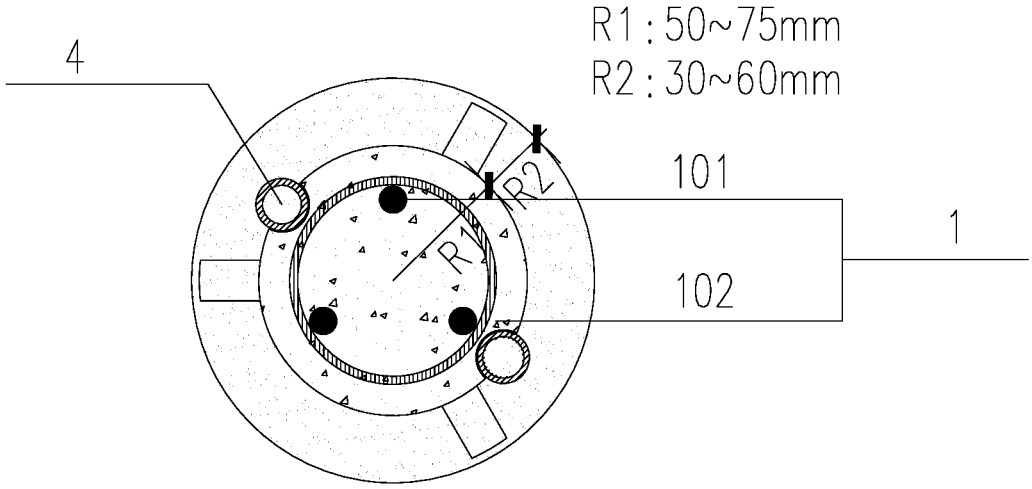
FIG. 3 is a sectional view taken along A-A in FIG. 2.

As shown in FIG. 3, due to the small diameter of the anchor, the radius R1 of the pre-stressed concrete mandrel 1 is 50-75 mm, the thickness of the cast-in-place anchoring slurry 2 is 30-60 mm, and a pre-stressed tendon can be used in the pre-stressed concrete mandrel 1; considering factors such as transportation and construction deviation, three pre-stressed tendons can also be set in the mandrel to enhance the bending resistance of the mandrel body. The pre-stressed concrete mandrel 1 can be pre-stressed rebars or steel strands. The cast-in-place anchoring slurry 2 is a cement slurry.

Figure 4:
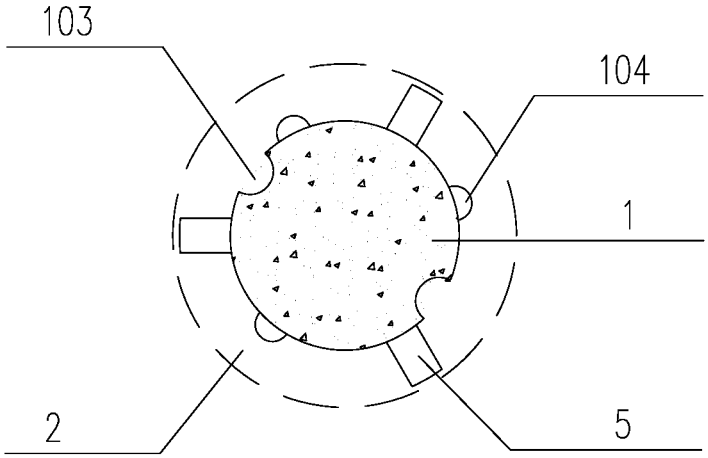
FIG. 4 is a sectional schematic view of the anchor assembly with a mandrel positioning device.

As shown in FIG. 4, in order to enhance the bonding performance between the pre-stressed concrete mandrel 1 and the cast-in-place anchoring paste 2, bamboo-like or point-like protrusions 104 may be provided on the outer peripheral surface of the pre-stressed concrete mandrel 1. The mandrel body is generally round, but it can also adopt square, oval or other cross sections. At the same time, in order to avoid the offset during placing the pre-stressed concrete mandrel in the pile hole, the pre-stressed concrete mandrel 1 is preferably provided with a mandrel positioning device 5, which can be 30×30×h protrusions (h is the distance from the mandrel to the hole wall −0.5 cm), with three protrusions along the circumferential direction and two turns along the longitudinal direction. At the same time, the pre-stressed concrete mandrel 1 is provided with a grouting pipe preformed groove 103 for binding the grouting pipe before the mandrel is lowered into the pile hole. There are 2 grouting pipes, which are used for primary grouting and secondary grouting respectively.

Figure 5:
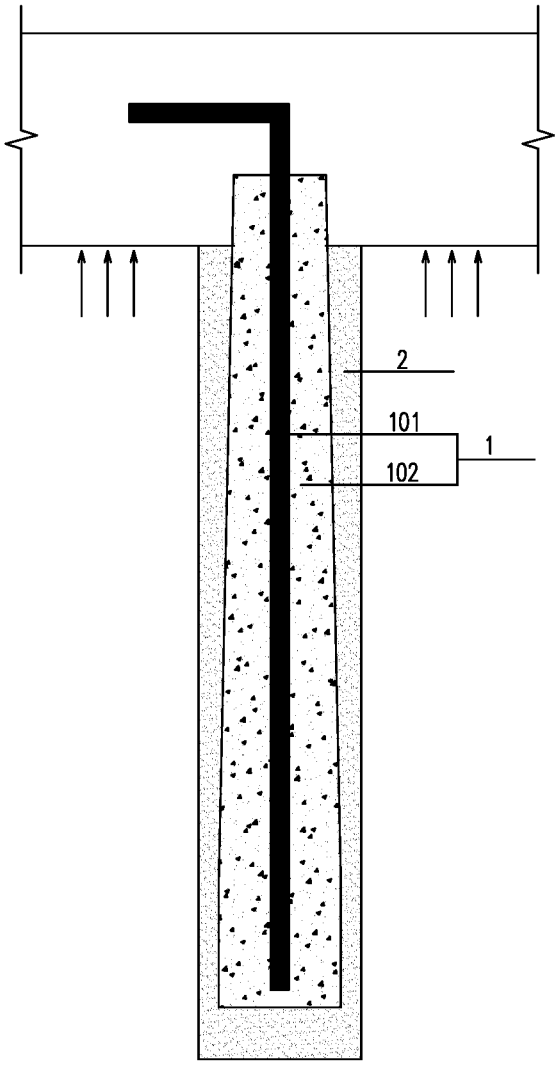
FIG. 5 is a schematic diagram of the anchor assembly when the mandrel is frustum-shaped.

As shown in FIG. 5, the pre-stressed concrete mandrel is preferably frustum-shaped; at this time, under the action of tensile force, the pre-stressed concrete mandrel 1 can squeeze the cast-in-place anchoring slurry 2 and the hole wall, and the anchor assembly has better bearing capacity. In addition, because of the prefabrication in the factory, the mandrel is easy to realize, while the previous on-site grouting anchor cannot be realized.

In order to avoid the offset during the placing process of the mandrel, the mandrel body is preferably provided with a three-way positioning device, which can be 30×30×h protrusions (h is the distance from the mandrel to the hole wall −0.5 cm), with three protrusions arranged along the circumferential direction and two turns arranged along the longitudinal direction. At the same time, the mandrel is provided with a grouting pipe preformed groove for binding the grouting pipe before lowering the hole. There are 2 grouting pipes, which are used for primary grouting and secondary grouting respectively.

The construction method of the anchor assembly having a pre-stressed mandrel of the present application includes the following steps:

S1, prefabricating a pre-stressed concrete mandrel 1 by a pretensioning method in a factory, wherein the diameter of the prefabricated mandrel is controlled between 100 mm and 150 mm; tensioning the rebar on the pedestal first, then pouring the concrete mandrel, and preforming a grouting pipeline in the mandrel; after the strength reaches a design value, releasing the tension end to make the mandrel form a prestress; at the same time, reserving a section of the rebar at one side of the mandrel for anchoring, and cutting off the rebar at the other side along an end of the mandrel;

S2, drilling holes by a drilling machine on a construction site;

S3, hole cleaning, binding the grouting pipe, and then lowering the prefabricated mandrel to ensure that the pre-stressed concrete mandrel and the drilling hole are coaxial;

S4, performing primary grouting around the pre-stressed concrete mandrel, and performing secondary grouting as a cast-in-place anchoring slurry after solidification and shrinkage followed by the primary grouting;

S5, anchoring the rebar reserved in the mandrel into a bottom slab, and pouring the bottom slab so as to complete basement construction.

Different from the conventional pre-stressed members, because the diameter of the anchor is generally 150-240 mm and the length is 4-15 m, considering the peripheral anchoring slurry, the pre-stressed concrete mandrel 1 of the present application has a smaller diameter, and the application of the prestress must ensure the positioning accuracy of the pre-stressed tendons, avoid the additional bending moment caused by deviation, and better reflect the advantages of prefabricated production in factories.

Because of the small cross section of the mandrel, the prestress degree will be significantly higher than that of ordinary pre-stressed members, and the elastic compression deformation and later shrinkage and creep will further increase the prestress loss. At present, according to the current Specifications for Design of Concrete Structures, the prestress loss of pretensioned axial compression members is shown in the first four items in Table 1. The loss of prestress in the table does not include the loss caused by the compression of the mandrel body caused by the release of the tensioned rebar. In view of the small cross-section of the mandrel, the prestress loss $\sigma_s$ is supplemented on the basis of existing specifications through analysis.

TABLE 1

Analysis of prestress loss

| Causes of prestress loss | computing formula | remarks |
|---|---|---|
| Deformation of an anchorage at the tension end | $\sigma_{l1} = \frac{a}{l}E_s$ | a-anchorage deformation value<br>l-the distance between the tensioning end and the anchoring end<br>$E_s$-elastic modulus of the rebar |
| Influence of temperature difference in concrete curing | $\sigma_{l3} = 2\Delta t$ | Δt-temperature difference between pre-stressed tendons and equipment under tension |
| Prestress relaxation of pre-stressed rebar | $\sigma_{l4} = 0.03\sigma_{con}$ | $\sigma_{con}$-tension control stress of the pre-stressed rebar |
| Shrinkage and creep of the concrete | $\sigma_{l5} = \frac{60 + 340\frac{\sigma_{pc}}{f_{cu}}}{1 + 15\rho}$ | $\sigma_{pc}$-compressive stress of the pile concrete<br>$f_{cu}$-Cubic compressive strength of the pile concrete<br>ρ-rebar ratio of the uplift pile |

TABLE 1-continued

| Analysis of prestress loss | | |
|---|---|---|
| Causes of prestress loss | computing formula | remarks |
| Compression deformation of the concrete | $\sigma_s = \frac{N_s}{A_s + A_c \frac{E_c}{E_s}}$ | $N_s$-Tension control force of the pre-stressed rebar<br>As, Ac-the areas of the pre-stressed rebar and the concrete, respectively<br>$\sigma_s$-loss stress of the pre-stressed rebar<br>$E_c$-elastic modulus of the concrete |

Next, an example is given to prove the superiority of the anchor assembly of the present application and calculate its prestress loss.

The prestress loss of a 8 m composite uplift pile is analyzed, and the calculation results are shown in Table 2, wherein the strength grade of the concrete is C40, and the diameter of pile mandrel is 150 mm; the diameter of the pre-stressed tendons is 12.6 mm, the number is 3, and the tension control stress is 994 Mpa.

TABLE 2

| Analysis of prestress loss of a 15 m composite uplift pile | | |
|---|---|---|
| Types of prestress loss | Calculation result/(N/mm$^2$) | remarks |
| $\sigma_{l1}$ | 75 | Take $\alpha$ = 3 mm |
| $\sigma_{l3}$ | 40 | Take $\Delta t$ = 20° C. |
| $\sigma_{l4}$ | 29.8 | — |
| $\sigma_s$ | 164.0 | — |
| $\sigma_{l5}$ | 99.7 | — |

The example shows that the elastic shrinkage deformation loss accounts for 24.4% of the total loss. In order to reduce this part of the prestress loss, it is preferable to add an appropriate amount of an expansion agent to the mandrel body. The compressive stress in the mandrel body can be ensured by the later expansion of the concrete, and the pressure between the composite pile and the rock and soil can also be increased, thus enhancing the uplift bearing capacity of the anchor assembly. Compared with the non-pre-stressed anchor, the steel consumption is 20-30% of the original consumption.

Those skilled in the art can understand that the above is only a preferred example of the present application, and is not used to limit the present application. Although the present application has been described in detail with reference to the aforementioned examples, for those skilled in the art, they can still modify the technical solutions described in the aforementioned examples, or replace some of the technical features equally. All modifications and equivalent substitutions within the spirit and principles of the present application shall be included in the scope of protection of the present application.

What is claimed is:

1. An anchor assembly having a pre-stressed mandrel, comprising:

a pre-stressed concrete mandrel positioned at an inner side, wherein pre-stressed tendons are arranged inside the pre-stressed concrete mandrel and are prefabricated by a pretensioning method; and a cast-in-place anchoring slurry positioned at an outer side, which wraps the pre-stressed concrete mandrel, and is formed by placing the pre-stressed concrete mandrel in a pile hole and solidifying the anchoring slurry after primary grouting or secondary grouting;

wherein the outer peripheral surface of the pre-stressed concrete mandrel is provided with a mandrel positioning device;

wherein the mandrel positioning device is a three-way positioning device with protrusions along a circumferential direction of the pre-stressed concrete mandrel; and wherein an outer circumferential surface of the pre-stressed concrete mandrel is further provided with a grouting pipe preformed groove.

2. The anchor assembly having a pre-stressed mandrel according to claim 1, wherein there are three pre-stressed tendons in the pre-stressed concrete mandrel.

3. The anchor assembly having a pre-stressed mandrel according to claim 1, wherein a radius R1 of the pre-stressed concrete mandrel is 50-75 mm, and a thickness of the anchoring slurry is 30-60 mm.

4. The anchor assembly having a pre-stressed mandrel according to claim 1, wherein the anchoring slurry is a cement slurry.

5. The anchor assembly having a pre-stressed mandrel according to claim 1, wherein the pre-stressed concrete mandrel is in a shape of a frustum with a small top and a large bottom.

6. The anchor assembly having a pre-stressed mandrel according to claim 1, wherein the three-way positioning device comprises three protrusions in one turn along a circumferential direction and two turns along a longitudinal direction of a mandrel body of the pre-stressed concrete mandrel, and wherein the protrusions are bamboo-like or point-like protrusions.

7. A construction method of the anchor assembly having a pre-stressed mandrel according to claim 1, comprising the following steps:

S1, prefabricating a pre-stressed concrete mandrel by a pretensioning method in a factory, wherein a diameter of the prefabricated mandrel is controlled between 100 mm and 150 mm; tensioning a rebar on a pedestal first, then pouring a concrete mandrel, and preforming a grouting pipeline in the mandrel; after a strength reaches a design value, releasing a tension end to make the mandrel form prestress; at the same time, reserving a section of the rebar at one side of the mandrel for anchoring, and cutting off the rebar at the other side along an end of the mandrel;

S2, drilling holes by a drilling machine on a construction site;

S3, hole cleaning, binding the grouting pipe, and then lowering the prefabricated mandrel to ensure that the pre-stressed concrete mandrel and the drilling hole are coaxial;

S4, performing primary grouting around the pre-stressed concrete mandrel, and performing secondary grouting as a cast-in-place anchoring slurry after solidification and shrinkage followed by the primary grouting;

S5, anchoring the rebar preformed in the mandrel into a bottom slab, and pouring the bottom slab so as to complete basement construction.

8. The construction method of the anchor assembly having a pre-stressed mandrel according to claim 7, wherein an expansion agent is added to the concrete when pouring the concrete mandrel in S1.

* * * * *